US006902765B2

(12) United States Patent
Brandes et al.

(10) Patent No.: US 6,902,765 B2
(45) Date of Patent: Jun. 7, 2005

(54) METHOD FOR ELECTROLESS METAL PLATING

(75) Inventors: Mariola Brandes, Berlin (DE); Herman Middeke, Guangzhou (CN); Brigitte Dyrbusch, Berlin (DE)

(73) Assignee: Atotech Deutschland GmbH, Berlin (DE)

( * ) Notice: Subject to any disclaimer, the term of this patent is extended or adjusted under 35 U.S.C. 154(b) by 0 days.

(21) Appl. No.: 10/415,585

(22) PCT Filed: Oct. 4, 2001

(86) PCT No.: PCT/EP01/11468

§ 371 (c)(1),
(2), (4) Date: Jun. 9, 2003

(87) PCT Pub. No.: WO02/36853

PCT Pub. Date: May 10, 2002

(65) Prior Publication Data

US 2004/0086646 A1 May 6, 2004

(30) Foreign Application Priority Data

Nov. 1, 2000 (DE) ..... 100 54 544

(51) Int. Cl.[7] ..... B05D 3/10; B05D 1/18
(52) U.S. Cl. ..... 427/305; 427/438
(58) Field of Search ..... 427/304, 305, 427/306, 438

(56) References Cited

U.S. PATENT DOCUMENTS

| | | | | |
|---|---|---|---|---|
| 3,011,920 A | | 12/1961 | Shipley et al. | |
| 4,035,227 A | * | 7/1977 | Doty et al. | 216/83 |
| 4,204,013 A | * | 5/1980 | Arcilesi et al. | 427/304 |
| 4,244,739 A | * | 1/1981 | Cagnassi | 106/1.11 |
| 4,355,083 A | * | 10/1982 | Feldstein | 428/621 |
| 4,582,729 A | * | 4/1986 | Tsiamis et al. | 427/304 |
| 5,395,651 A | * | 3/1995 | Sodervall et al. | 427/304 |
| 5,935,706 A | * | 8/1999 | Hoover et al. | 428/375 |

FOREIGN PATENT DOCUMENTS

| | | | |
|---|---|---|---|
| DE | 119 7720 | | 6/1960 |
| DE | 1197720 | * | 6/1960 |
| DE | 292869 | | 2/1980 |
| EP | 0616053 | | 9/1994 |
| JP | 11241170 | | 9/1999 |

OTHER PUBLICATIONS

Designation B727–83, Standard Practice for Preparation of Plastic Materials for Electroplating, 1995, pp 451–455.
Metallmethansulfonate by D. Guhl and F. Honselmann in Metalloberflache, vol. 54 pp 34–37 (2000, no mo.).
Kunststoffmetallisierung, Manual for Theory and Practical Application, published by Eugen G. Leuze, Saulgau 1991, pp 46–47.

* cited by examiner

*Primary Examiner*—Michael Cleveland
(74) *Attorney, Agent, or Firm*—Paul & Paul

(57) ABSTRACT

A method for electroless metal plating of substrates, more specifically with electrically non-conductive surfaces, by which the substrates may be reliably metal plated at low cost under manufacturing conditions as well and by means of which it is possible to selectively coat the substrates to be treated only, and not the surfaces of the racks. The method involves the following steps: a. pickling the surfaces with a solution containing chromate ions; b. activating the pickled surfaces with a silver colloid containing stannous ions; c. treating the activated surfaces with an accelerating solution in order to remove tin compounds from the surfaces; and d. depositing, by means of an electroless nickel plating bath, a layer that substantially consists of nickel to the surfaces treated with the accelerating solution, the electroless nickel plating bath containing at least one reducing agent selected from the group comprising borane compounds.

9 Claims, No Drawings

METHOD FOR ELECTROLESS METAL PLATING

The invention relates to a method for electroless metal plating of surfaces, more specifically of surfaces made of acrylonitrile/butadiene/styrene copolymers (ABS) and of mixtures thereof with other plastics materials (ABS blends) as well as surfaces made of polyamide derivatives, of blends thereof, of polypropylene derivatives and of blends thereof.

Plastic parts are specifically coated with metal for decorative applications. Sanitary appliances, motorcar accessories, furniture fittings, fashion jewelry and buttons for example are metal plated either all over or in parts only in order to make them attractive. Plastic parts are also metal plated for functional reasons, housings of electrical appliances for example in order to achieve efficient shielding from emission or immission of electromagnetic radiation. Moreover, surface properties of plastic parts may be modified specifically by metallic coatings. In many cases, the copolymers used are made of acrylonitrile, butadiene and styrene and of blends thereof with other polymers such as polycarbonate.

To produce metallic coatings on plastic parts, these are usually fastened onto racks and brought into contact with processing fluids in a determined sequence.

For this purpose, the plastic parts are usually submitted first to a pretreatment in order to remove any contamination such as grease from the surfaces. Moreover, in most cases, etching processes are performed to roughen the surfaces so that efficient bonding to them is provided.

Then, the surfaces are treated with so-called activators to form a catalytically active surface for subsequent electroless metal plating. For this purpose, so-called ionogenic activators or colloidal systems are utilized. In: "Kunststoffmetallisierung" (Plastic Metallization), Manual for Theory and Practical Application, published by Eugen G. Leuze, Saulgau, 1991, pages 46, 47, there is indicated that, for activation with ionogenic systems, the plastic surfaces are treated with stannous ions first, tightly adhering gels of hydrated stannic acid forming during the process of rinsing with water that takes place after treatment with stannous ions. During further treatment with a solution of a palladium salt, palladium nuclei form on the surfaces through reduction with tin(II)-species that function as catalysts for electroless metal plating. For activation with colloidal systems, solutions of colloidal palladium are generally utilized that are formed by reaction of palladium chloride with stannous chloride in the presence of excess of hydrochloric acid (Annual Book of ASTM Standard, Vol. 02.05 "Metallic and Inorganic Coatings; Metal Powders, Sintered P/M Structural Parts", Designation: B727–83, Standard Practice for Preparation of Plastic Materials for Electroplating, 1995, pages 446–450).

Upon activation, the plastic parts are at first metal plated utilizing a metastable solution of a metal plating bath (electroless metal plating). These baths contain the metal to be deposited in the form of salts dissolved in aqueous solution as well as a reducing agent for the metal salt. Metal is only formed by reduction when the plastic surfaces provided with the palladium nuclei are treated with an electroless metal plating bath, said metal being deposited onto the surfaces to form a tightly adherent layer. Usually, copper or nickel or a nickel alloy containing phosphorus and/or boron are deposited.

Further layers of metal may then be electrolytically deposited onto the plastic surfaces that have been coated by means of the electroless metal plating bath.

In U.S. Pat. No. 4,244,739 there is described a colloidal activating solution for electroless deposition of metal onto non-conductive or only partially conductive bases, said solution being prepared by mixing at least one water-soluble salt of a noble metal (metal of group I or VIII of the Periodic Table of the Elements) with at least one water-soluble salt of a metal of group IV of the Periodic Table of the Elements and with an aliphatic sulfonic acid in an aqueous solution. The preferred noble metal is indicated to be palladium and the preferred salts of the metal of group IV are stannous salts.

Recently, so-called direct metallization processes have been utilized. EP 0 616 053 A1 for example describes a process for applying a metal coating to a non-conductive substrate without using electroless metal deposition. The substrate is first activated with a colloidal palladium/tin-activator and then treated with a solution that contains, among others, copper ions and a complexing agent for copper ions. Thereupon metal may be electrolytically deposited.

The known methods have the disadvantage that the noble metal usually utilized to activate non-conductive surfaces is palladium. Since palladium is very expensive, an equivalent substance that is less expensive than palladium has been looked for.

JP-A-11241170 indicates an aqueous activating solution that is prepared from a silver salt, an anionic surface active agent, a reducing agent and nickel, iron or cobalt compounds. The silver salts suggested are among others inorganic silver salts such as silver nitrate, silver cyanide, silver perchlorate and silver sulfate, as well as organic silver salts such as silver acetate, silver salicylate, silver citrate and silver tartrate. The surface active agents suggested are alkyl sulfates, alkyl benzene sulfonates, polyoxyalkylene alkyl ester, salts of sulfosuccinic acid, lauryl phosphates, polyoxyethylene stearylether phosphates, polyoxyethylene alkylphenylether phosphates as well as derivatives of taurine and sarcosine. The reducing agents proposed are alkali borohydride, amine boranes, aldehydes, ascorbic acid and hydrazine. The nickel, iron and cobalt compounds suggested are the inorganic salts thereof, complexes of ammonia and diamine. The document indicates that the activating solution may be utilized to metal plate printed circuit boards, plastics, ceramics, glass, paper, textiles and metal. Upon activation, the materials may among others be coated with copper and nickel with electroless metal plating.

In "Metallmethansulfonate" ("Metal Methane Sulfonates") by D. Guhl and F. Honselmann in Metalloberfläche, Vol. 54 (2000) 4, pages 34–37, there is furthermore indicated a method for metal plating non-conductive surfaces. At first, the surfaces are degreased. Then they are pickled by means of a chromic acid/sulfuric acid solution. Afterwards the surfaces are activated in a solution of colloidal silver containing methane sulfonic acid, silver methane sulfonate and stannous methane sulfonate. Thereafter the surfaces are treated with a solution of oxalic acid. Subsequently, the surfaces are copper or nickel plated by means of commercial electroless metal plating baths. It is for example suggested to metal plate ABS by means of this method.

The known methods for activating non-conductive surfaces with silver nuclei proved not to be suited for applying in particular layers of nickel or nickel alloys under manufacturing conditions to the surfaces reliably. It has been observed that layers of nickel and of nickel alloys may be securely deposited under manufacturing conditions when palladium is utilized as a noble metal for activation.

However, layers of nickel and of nickel alloys cannot be deposited reliably when silver is being used as an activating metal. In "Metallmethansulfonate" there is stated in this respect that layers of nickel may be chemically deposited using silver colloids containing methane sulfonate. However, this cannot be confirmed when the method is carried out under manufacturing conditions. More specifically, in this case, it is not possible to reliably achieve electroless nickel plating on non-conducting surfaces. The process parameters could be optimized such that plastic parts were completely plated even to such locations on the parts that are difficultly to plate, for example hidden areas on the surface of complicately shaped parts. Under these conditions however, either the silver colloid and/or the electroless nickel bath proved to be unstable to flocculation. For running the process disclosed under manufacturing conditions it is absolutely necessary to have at one's disposal treatment baths that are sufficiently stable against decomposition and at the same time to guarantee electroless plating at all locations on the surface of the plastic parts even if some of these locations may eventually be difficult to coat with metal. It has been found out, when using the process described in "Metallmethansulfonate", that either reliable electroless nickel plating of all locations on the surface of the plastic parts was not possible or that the silver colloid and/or the electroless nickel plating bath were inclined to decompose i.e., to deposit metal on the walls of the tank and on the metal racks holding the plastic parts and/or to form precipitations in the activating solution. Therefore the process disclosed in this document has proven to be not at all suitable to be utilized in a manufacturing plant.

The main object of the present invention is therefore to provide a method for electroless metal plating of substrates, more specifically electroless metal plating of substrates comprising electrically non-conductive surfaces.

A further object of the present invention is to provide a method for electroless plating of substrates, the method being particularly suitable to reliably metal plate the substrates under manufacturing conditions.

Still another object of the present invention is to provide a method for electroless plating of substrates, avoiding completely the use of palladium.

Still another object of the present invention is to provide a method for electroless metal plating of substrates, the cost of the method being reduced compared to conventional processes.

Still another object of the present invention is to provide a method for electroless metal plating of substrates, the method being suitable to selective coating of only the substrates to be treated and not of the surfaces of the racks to which the substrates are fastened for carrying out the method.

The method according to the present invention serves to electroless plating of surfaces. It comprises the following method steps:

a. pickling the surfaces with a solution containing chromate ions;
b. activating the pickled surfaces with a silver colloid containing stannous ions;
c. treating the activated surfaces with an accelerating solution in order to remove tin compounds from the surfaces;
d. depositing, by means of an electroless nickel plating bath, a layer that substantially consists of nickel to the surfaces treated with the accelerating solution, the electroless nickel plating bath containing at least one reducing agent selected from the group comprising borane compounds.

In principle, substrates made of any material may be metal plated. The method is more specifically suited to metal plate electrically non-conductive substrates. The substrates may be provided with non-conductive surfaces either all over or at least on parts thereof. The non-conductive surfaces may be made of plastics, ceramics, glasses or may be any other electrically non-conductive surfaces. It is also possible to metal plate metal surfaces. The method is more specifically utilized to metal plate ABS and ABS blends. Other plastics are for example polyamides, polyolefines, polyacrylates, polyester, polycarbonate, polysulfones, polyetherimide, polyethersulfone, polytetrafluor ethylene, polyaryl ether ketone, polyimide, polyphenylene oxide as well as liquid crystal polymers. In printed circuit board technique, metal coatings are utilized to render the boards electrically conductive, the boards being made of cross-linked epoxy resins normally being reinforced by glass fibers or other reinforcing material. The metal coatings are made to form circuit traces, connecting pads or for through hole plating. Materials for printed circuit boards may also be metal plated.

Above all, the method according to the present invention permits to metal plate electrically non-conductive surfaces, but also surfaces of other substrates, at low cost utilizing for activation a silver colloid instead of a palladium colloid. Furthermore, the method makes it possible to reliably coat non-conductive surfaces with nickel and nickel alloys even in surface areas that are not easily plateable. In order to achieve reliable coating, it is not necessary to adjust the conditions for electroless nickel coating in such a manner that the nickel bath tends to decompose, forming nickel deposits on the walls of the tank for example, by increasing temperature of the nickel bath, concentration of the reducing agent in the nickel bath, pH, concentration of nickel ions in the bath and/or by reducing concentration of complexing agents contained in the nickel bath. Also, it is not necessary to adjust the operating conditions of the solution of colloidal silver in such a manner that it decomposes during operation.

Furthermore, the method according to the present invention also permits to exclusively coat the plastic parts to be coated but not the surfaces of the racks to which the parts are fastened while the method is being performed (selective plating). In tests for determining adsorption of silver in carrying out the method according to the invention and in using palladium as a noble metal for activation as well, it has been ascertained that a PVC-coating usually used to protect the surfaces of the racks adsorbs little silver only, whereas the surfaces to be treated take up silver in an amount that is sufficient for activation.

In contrast to the method according to the present invention known methods, including the method disclosed in the "Metallmethansulfonate" reference, suffer from a main disadvantange: The main deficiency of known methods is that either reliable plating cannot be achieved even at locations on the surfaces to be coated that may not be easily metal plated while stability of the silver colloid and the electroless nickel plating bath may be guaranteed or that reliable plating may be guaranteed but stability of the silver colloid and/or the electroless nickel plating bath cannot be maintained. This overall deficiency has been felt inherent in the known method. Using the novel method according to the present invention this problem has now been overcome.

The reason for this problem has been suggested to be a too low electrical potential for electroless plating at catalytic nuclei formed on the substrate surfaces. It seems that this too low electrical potential is the consequence of utilizing hypophosphite compounds or any other reducing compound in the nickel bath that does not have the required properties.

Further deposition of nickel has indeed been reported in the "Metallmethansulfonate" reference. It has been found out, however, that traces of palladium have always been ubiquitous in the processing solutions, in the pickling solution or in the accelerating solution for example, these traces being responsible for starting electroless nickel plating and thereby obviating the need of optimizing the process (optimization of concentrations of reducing agent and complexing agents as well as of pH and of temperature in the electroless nickel plating bath) in order to guarantee reliable plating of the non-conducting surfaces and at the same time to avoid instability problems associated with the silver colloid and with the plating solution. Utilizing the novel method offers the important advantage that the life cycle of the electroless nickel plating bath used is considerably enhanced.

Further it has been found out that the accelerator composition disclosed in the "Metallmethansulfonate" reference (1 molar oxalic acid solution) does not lead to a reliable plating result (see Example 6). The accelerator component is suggested to serve to remove tin species from the adsorbed colloid particles in order to expose silver nuclei. Since solubility of oxalate salts is relatively poor in water (solubility of tin oxalate at 25° C.: $2.6 \cdot 10^{-4}$ g per 100 g solution) solubilization of the tin salts should effectively not be successful as shown when an aqueous solution of oxalic acid is used as the accelerator. Therefore utilization of oxalic acid as an accelerator component should to be avoided as far as possible.

It has been found out accidentally that borane compounds, especially borohydride compounds, being utilized as the reducing agents in electroless nickel plating baths are suitable to overcome the aforementioned problems. Under these conditions electroless nickel plating baths exhibit excellent starting behaviour in nickel plating and a high nickel plating rate even at low temperature. If for example dimethylamine borane as a reducing agent is utilized, this agent being relatively stable to decomposition, use of any further reducing agent is not required. Even at a temperature of as low as 40° C. and even without getting along with any palladium traces in the processing solutions reliable metallization on a plastic surface is achieved that has been activated by means of a silver colloid.

Aqueous solutions are preferably utilized for carrying out the method in accordance with the invention. This is true not only for the very first stages of the treatment such as for the pickling solution and the colloidal silver solution but also for the rinsing steps in between these stages. In principle, solutions may also be used that contain, instead of water as a solvent, inorganic or organic solvents. However, water is to be preferred because it is ecological and cheap.

The following description of the method according to the invention is directed to the metal plating of plastic parts, more specifically of ABS and of ABS blends. To metal plate other materials within the scope of the present invention, polyamide, polyamide derivatives and blends thereof or polypropylene, polypropylene derivatives and blends thereof for example, the method is to be adapted accordingly. It may more particularly be necessary to provide further stages of pretreatment, such as to hydrophilize the surfaces of the materials first. For this purpose, treatment with solutions of surface active agents and/or with organic solvents and/or with other oxidizing agents may be provided and/or vacuum etching processes be utilized.

The solution of colloidal silver is preferably prepared by mixing a solution containing silver ions and a solution containing stannous (Sn(II)) ions. The silver compound is thereby reduced by the stannous compound, which yields particles of colloidal silver. The stannous compounds simultaneously oxidize to form stannic (Sn(IV)) compounds, hydrated stannic oxide probably, which is likely to form a protective colloidal sheathing for the particles of colloidal silver. After a period of maturation at room temperature, the activating solution is ready for use.

An aqueous solution of silver salts may for example be utilized as an aqueous solution containing silver ions. The silver salt preferably used should be sufficiently soluble in water, such as silver methane sulfonate and silver nitrate. Silver methane sulfonate e.g. may either be utilized directly or be formed by causing the oxide, hydroxide, carbonate or other silver salts to react with methane sulfonic acid. An aqueous solution of a stannous salt, preferably a solution of stannous methane sulfonate, is preferably utilized as a solution containing stannous ions. Furthermore, the solution preferably contains methane sulfonic acid in excess. In principle, other silver salts and stannous salts as well as one or several other acids may be used. Concentration of stannous methane sulfonate in the colloidal solution is preferably greater than concentration of the silver methane sulfonate. It is more specifically at least twice the concentration of the silver methane sulfonate.

For preparing the colloidal silver solution, the concentrations of the main constituents preferably amount to 100–2,000 mg $Ag^+$, preferably to 150–400 mg, for silver methane sulfonate, to 1.5–10 g $Sn^{2+}$ for stannous methane sulfonate and to 1–30 g of a solution containing 70% by weight of methane sulfonic acid for 1 liter of colloidal silver solution. Tests for the adsorption of silver at ABS surfaces permitted to determine that the amount of adsorbed silver increases as the amount of silver contained in the colloidal solution rises.

It is advantageous to first prepare a concentrated solution of the silver colloid, concentration of silver ions ranging from 1.5–10 g/l and amounting preferably to 2 g/l. Before imminent use, this solution is adjusted to the required silver ion concentration by diluting it with a concentrated solution of stannous methane sulfonate or of methane sulfonic acid. To prepare the colloidal solution, an aqueous solution of silver methane sulfonate, an aqueous solution of stannous methane sulfonate and an aqueous solution of methane sulfonic acid (which is usually commercially available in the form of an 70% by weight aqueous solution) may be prepared. The order in which the three solutions are mixed together is discretional. The solution of silver methane sulfonate may for example be provided, the solution of methane sulfonic acid added thereto, the two may be mixed and finally, the solution of stannous methane sulfonate may be added to the mixture of the two first solutions. Still at room temperature the solution turns from colorless clear to yellowish tending toward brown by passing through a greyish pink color, color of the solution deepening continuously. After the period of maturation, the colloidal solution has a very dark color. As soon as the colloidal solution achieves this tone it is ready for use. The period of maturation may be considerably accelerated when temperature is increased during the process of maturation. Temperature may for example be raised to 40° C. If, during the process of maturation, temperature is raised to too high a value, a precipitation may form in the colloidal solution, said precipitation being the result of decomposition of the silver colloid. Accordingly, too high a temperature is to be avoided.

To further optimize the method according to the present invention, the colloidal silver solution may additionally contain at least one further reducing agent in addition to the stannous salts. These further reducing agents may be selected from the group comprising hydroxyphenyl compounds, hydrazine and derivatives thereof. The derivatives of hydrazine more specifically also include the salts thereof. Hydroquinones and resorcin are particularly suited as hydroxy compounds. Upon maturation, these substances may preferably be added to the colloidal solution in the form of an aqueous solution.

Furthermore, the colloidal silver solution may contain copper ions. Respective components may be added to the solution in the form of a copper salt more particularly, in the form of copper methane sulfonate for example. Addition of copper ions accelerates the process of maturation of the colloidal solution. As a result thereof, a process of maturation that originally took several days the maturation time being thus be reduced to 3–6 hours. In the same way, the process of maturation may also be accelerated by adding hydrazine, e.g., in a concentration of 2–5 g/l, or by adding the salts thereof.

To use the colloidal silver solution in the method according to the present invention, temperature thereof is adjusted to a value of 80° C. maximum. Preferably temperature is adjusted through a range of 40–70° C. and more specifically through a range of 50–60° C.

To metal plate plastic parts made of ABS or ABS blends, the parts are first pickled in a solution containing chromate ions in order to roughen the surface. A chromic acid/sulfuric acid solution is preferably used, said solution containing more specifically 320–450 g/l chromium trioxide, preferably 360–380 g/l chromium trioxide, as well as 320–450 g/l concentrated sulfuric acid, preferably 360–380 g/l concentrated sulfuric acid.

The solution, which contains chromate ions, may additionally contain palladium ions though it is recommended to manage without this noble metal in order to reduce cost. For this purpose, at least one palladium salt, more specifically palladium sulfate or other palladium salt that is soluble in the pickling solution, is added to this solution. The concentration of palladium ions in the pickling bath preferably amounts to 1–20 mg/l, more specifically preferably to 5–15 mg/l. In assays for the adsorption of silver on ABS surfaces after treatment with the colloidal silver solution at a common treatment time, it was ascertained that there is no significant difference in the amount of adsorbed silver on the surfaces after treatment with a pickling solution containing palladium ions and after treatment with a pickling solution that does not contain any palladium ions when the silver ion concentration in the colloidal solution is adjusted through the range of 50–1000 mg/l which is currently used for practical application. By contrast, the initiation period for electroless coating with nickel (period of time between the first contacting of the surface and the starting of the electroless nickel bath) may considerably be reduced by adding palladium ions to the pickling solution. This period of time may for example be reduced by a factor of 3 when the pickling solution contains approximately 10 mg/l of palladium ions. A more reliable coating with nickel is thus made possible. This means that even areas on the surfaces of plastic parts that are more difficult to coat may under these further conditions be coated with nickel without any problem.

For the metal plating process, the pickling solution is heated to a temperature of 65° C. The solution may of course be cooler or hotter and have a temperature of 40° C. or 85° C. for example. Depending on the kind of plastic part to be treated, processing time in the pickling solution may amount to 1–30 min.

With known methods for pretreating ABS and ABS blends, the plastic surfaces are, upon pickling, rinsed and then preferably treated with a solution containing a reducing agent for chromate ions, with a solution containing sulfites, hydrogen sulfites, hydrazine, the salts thereof, hydroxylamine or the salts thereof for example. Reduction proved however harmful to the method according to the present invention when sulfites, hydrogen sulfites and other sulfur compounds were utilized in which the sulfur had an oxidation number of +IV or less, since in this case the surfaces could not be efficiently activated.

Upon rinsing of the plastic surfaces, the plastic parts may be contacted with a solution that contains constituents which promote adsorption. What are termed conditioning solutions are utilized as solutions that promote adsorption. These are aqueous solutions that contain above all polyelectrolytes such as cationic polymers for example with a molecular weight in excess of 10,000 g/mol. Quaternized polyvinylimidazole and quaternized polyvinylpyridine compounds are used for example. In principle, other compounds may be utilized such as those indicated in Patent Documents No. DE 35 30 617 A1, U.S. Pat. No. 4,478,883 A, DE 37 43 740 A1, DE 37 43 741 A1, DE 37 43 742 A1 and DE 37 43 743 A1, herein incorporated by reference.

Then, the parts are rinsed again in order to remove excess conditioning solution from the surfaces.

Then, the plastic parts are preferably contacted with a pretreatment solution that contains above all the constituents of the colloidal silver solution e.g., methane sulfonic acid and stannous methane sulfonate or any other acid and the silver salt of this acid if the respective anion is also contained in the silver colloid. This solution serves to wet the plastic parts prior to contact with the colloidal silver solution so that concentration of all main constituents of the colloidal solution with the exception of the concentration of the silver methane sulfonate are not substantially modified by contacting the parts with the colloidal solution and by transferring the parts to the subsequent rinsing solution. For this purpose, concentration of these substances in the pretreatment solution is adjusted to approximately the same values as those adjusted in the colloidal solution. Moreover, this solution serves to protect the colloidal silver solution against the dragging in of disturbing substances.

After that, the plastic parts are directly brought into the colloidal silver solution without further rinsing step. Treatment in the colloidal solution causes silver nuclei to form on the plastic surfaces, said silver nuclei providing the surfaces with the required catalytic activity for subsequent electroless deposition of nickel or of a nickel alloy.

The amount of silver colloid reacting with the plastic surface has proved to increase with dwell time of the plastic parts in the activating solution.

Upon activation, the plastic surfaces are rinsed again to remove excess colloidal silver from the surfaces.

Then, the plastic parts are transferred to the accelerating solution. In the accelerating solution, silver nuclei are likely to be freed from their protective colloidal sheathing of tin (IV) through dissolution of the stannic compounds. The highly active silver nuclei thereby remain on the surfaces. They are activated in this solution such that as efficient initiation of electroless nickel plating is achieved as possible. Since in activating plastic parts silver is deposited together with tin species on the surfaces thereof, in general accelerating solutions have proved to be efficient to prepare the plastic surfaces for subsequent electroless plating which are able to remove tin species from the non-conducting surfaces by dissolution and further which leave the silver nuclei on the surfaces unaffected as far as possible.

By means of Atomic Force Microscopy (AFM) the size of the adsorbed particles originally having a diameter of approximately 30 nm on a substrate base could be ascertained to be reduced to a value of approximately 4 nm by way of subsequent treatment with the accelerating solution. Accordingly, major part of the particles is removed by the treatment. The reason thereof is the dissolution of the tin(IV)-sheathing of the particles. The sheathing is removed in a particularly efficient manner on account of the special formulation of the accelerating solution.

The accelerating solution preferably contains fluoride ions. This also includes the accelerating solution containing fluoborate ions, since aqueous solutions of fluoborate ions at least partly hydrolyze to fluoride ions and borate ions. For example fluoride ions and fluoborate ions may be provided to the accelerating solution as the alkali, ammonium or alkaline-earth fluorides or fluoborates, respectively, such as sodium fluoride or sodium fluoborate. Concentration of flouride ions in the solution more specifically amounts to 1–20 g/l, preferably to 5–15 g/l and most preferably to 8–12 g/l related to potassium fluoride, respectively.

The accelerating solution is preferably acidic. The pH of this solution may more specifically be adjusted to at least 7 and preferably to at least 2. However, it has emerged that strong (completely deprotonated) acids, such as hydrochloric acid, sulfuric acid or nitric acid may be detrimental. This may be attributed to dissolution of silver due to the effect of these acids and/or due to the inability of these acids to dissolve stannic species. Therefore weak acids are preferred. Use of methane sulfonic acid is preferred most. Therefore the accelerating solution additionally may contain methane sulfonate anions. The least concentration of the weak acid in the accelerating solution may be 40 g/l and more preferably 75 g/l.

In a particular embodiment of the invention the solution furthermore does not contain chloride ions, since it is believed that chloride ions tend to dissolve the silver nuclei deposited. The same should hold true for other substances that act as complexing agents for $Ag^+$. It is for this reason, too, that the solution should not contain hydrochloric acid and similar compounds.

In a preferred embodiment of the invention the accelerating solution further contains metal cations such as for example copper ions, iron ions and/or cobalt ions. It has proved especially advantageous to utilize copper compounds, the copper compounds preferably being employed as the copper salts of methane sulfonic acid. Though the impact of the metal cations on the initiation period of electroless nickel plating is low compared to that of fluoride ions and the acid in the accelerating solution, utilization of at least 20 g/l and preferably 40 g/l copper methane sulfonate render the method even more reliable and hence offer the opportunity to optimize parameters of the colloidal silver solution and/or of the electroless nickel plating solution such that stability thereof is sufficiently high.

After a subsequent rinsing step, the plastic surfaces are finally coated with nickel or with a nickel alloy in that they are contacted with an electroless nickel plating bath. The electroless nickel plating bath contains at least one nickel salt, preferably nickel sulfate, as well as complexing agents for the nickel ions, preferably carboxylic acids and hydroxy carboxylic acids such as succinic acid, citric acid, malic acid, tartaric acid and/or lactic acid as well as acetic acid, propionic acid, maleic acid, fumaric acid and/or itaconic acid. The pH of the bath is adjusted to 7.5–9.5. Moreover, the electroless nickel plating bath preferably contains a reducing agent, this agent being a borane compound, preferably sodium borohydride, potassium borohydride or any other borane compound, such as for example an amine borane, dimethylamine borane being the reducing agent of particular preference. Further the plating bath may also contain a further (second) reducing agent such as a hypophosphite compound, sodium hypophosphite, potassium hypophosphite or hypophosphorus acid for example. Due to the use of the borane compound as the reducing agent coating of the plastic surfaces is rendered more easy since even difficult to coat surface areas may under these conditions be nickel plated. Concentration of dimethylamine borane in the bath is adjusted to 0.5–10 g/l, preferably to 1–3 g/l.

Depending on its formulation, temperature of the nickel plating bath amounts to preferably 25–60° C. pH of the bath is adjusted to 6–10 according to its formulation.

Upon nickel coating, the plastic parts are rinsed and dried.

The following examples serve to further explain the invention:

All of the following examples relate to treatments that have been carried out according to the sequence of the method as indicated in Table 1.

EXAMPLE 1

To begin with, several colloidal silver solutions were prepared. The compositions thereof are indicated in Table 2.

The solutions were prepared by mixing the constituents in water in the sequence indicated (first addition of AgMS (MS: methane sulfonate) to water, then, addition of $Sn(MS)_2$, then addition of MSA (methane sulfonic acid)). Finally the solutions were left to stand at room temperature. The solutions generally started to turn green after half an hour already. However, the solution was only ready for use after approximately two days.

EXAMPLE 2

An injection-moulded plastic part having the shape of a housing for an electrical appliance and made of ABS was treated according to the processing sequence as indicated in Table 1.

The compositions of the individual processing solutions are indicated in Table 3.

After only a short coating time in the electroless nickel bath (approx. 5 sec.), the rising of bubbles of gas alongside the housing part denoted that a first reaction that was brought about by the deposition of nickel was taking place. Simultaneously, a coating that was black first formed on the surfaces of the housing. Within 30 sec a bright grey layer of nickel formed all over the entire surface of the housing part. Within 10 min, a layer of approximately 0.3 $\mu$m thick was deposited. The layer was lusterless and bright silvery. It coated the housing part at undercuts and in hollow spaces as well and adhered tightly to the surfaces. A so-called cross cutting test was performed by which several parallel cuts were made approximately 2 mm apart through the layer of nickel with a knife, first in one direction and then in a direction oriented at an acute angle thereto, so that areas formed between the cuts that were shaped like a parallelogram. The layer adhered very well to the areas. The layer of nickel could not even be removed by means of an adhesive tape.

EXAMPLE 3

In further tests, the influence of silver methane sulfonate concentration on the adsorption of silver on ABS boards and on ABS-blend boards was tested (ABS: Novodur P2MC of Bayer AG, ABS-blend: Bayblend T45 of Bayer AG). The results are indicated in Table 4.

The amount of adsorbed silver on the ABS and ABS-blend boards proved to increase with concentration of silver methane sulfonate in the colloidal solution.

EXAMPLE 4

In this test, the influence of an additive of copper ions in the form of copper methane sulfonate to the colloidal silver solution was tested by examining adsorption of Cu, Ag and Sn on ABS boards at two different concentrations of silver methane sulfonate in the solution.

For this purpose, the ABS boards were treated according to the treatment sequence as indicated in Table 1, the solutions having the compositions according to Table 3. The colloidal silver solution contained 22 g/l $Sn(MS)_2$ and 16 g/l of a 70% by weight solution of MSA. Adsorption was determined according to the following procedures:

Three test boards made of plastics having a defined surface size (6 cm×15 cm) were respectively treated with as much as 50 ml of a solution consisting of 20% by volume of concentrated nitric acid and of 80% by volume of a 50% by weight $HBF_4$ solution. The amounts of Cu, Ag and Sn contained in the thus obtained solution were determined by Atomic Absorption Spectroscopy (MS). The results are listed in Table 5.

During electroless nickel coating it was determined that addition of copper methane sulfonate to the colloidal silver solution increased activation of the ABS surfaces. This could be inferred from an accelerated start of the nickel deposition process. Table 5 shows that addition of copper ions reduces adsorption of silver. The activator matured faster when copper concentration was higher.

EXAMPLE 5

In further tests the influence of individual species in the accelerating solution on dissolution of tin and of silver after the activating step was examined. For this purpose plastic plates having a defined surface area were pretreated as previously described, afterwards activated and then exposed to the accelerating solution. Thereafter the plates were transferred to an electroless nickel plating bath in order to observe nickel plate triggering. Alternatively the plates were rinsed and dried in order to determine the amount of metal deposited on the plastic surface. Metal was then dissolved from the plastic surface with 50 ml of a mixture of a 50% by volume fluoboric acid solution and of a 65% by volume nitric acid solution, wherein the mixture had further been diluted with water at a volume ratio of 1:1. The amount of metal dissolved in this solution was then determined by Atomic Absorption Spectroscopy quantitatively. Table 6 shows the amount for silver and tin still being adsorbed on the plastic surfaces after acceleration. Further Table 6 shows the initiation period for each test, the period being determined as the time period between bringing the plastic plates into contact with the nickel plating bath and first gas evolution indicating nickel plating.

EXAMPLE 6

In order to evaluate the efficiency of acceleration and the effect thereof on electroless nickel plating plastic plates made of Bayblend T 45 (Bayer AG) were treated with the method by varying the composition of the accelerating solution.

For this purpose plastic plates each having a size of 15 cm×5 cm and having a thickness of 0.3 cm were pickled in a solution containing 380 g/l concentrated sulfuric acid and 380 g/l chromic acid for 15 min, thereafter were rinsed several times and then were contacted with a colloidal silver solution containing 0.6 g/l silver and 35 g/l methane sulfonic acid and stannous salt at a concentration of 4 g tin (II)/l. Temperature of the colloid was 50° C. and dwell time was 4 min. Thereafter the plates were rinsed with water and then each contacted with one of the aqueous solutions given in Table 7. Dwell time in these solutions was 3 min. Then the plates were again water-rinsed and finally dipped into an electroless nickel plating bath containing 3.5 g/l nickel (nickel sulfate), 2 g/l dimethylamino borane, 20 g/l citric acid and 10 g/l β-alanine at a pH of 8.5. Temperature of the nickel plating bath was 40° C.

Exclusively the plate which had been treated with accelerating solution no. 2 proved to be coated completely with a nickel layer within 1 min, whereas all the other plates even after 10 min treatment time had not been nickel plated at all.

From this experiment it may be concluded that the accelerator must be able to free the silver/tin colloid particles which are deposited during the activation step from tin selectively. Acid solutions which preferably contain fluoride are able to fulfill this requirement. All substances which are not able to dissolve tin or which even form unsoluble tin salts, such as oxalates for example, are not suitable for this purpose. Further substances which are able to dissolve silver by oxidation for example from the surfaces are not suitable as accelerating components as well.

EXAMPLE 7

In another test, the influence of various substances contained in the accelerating solution were tested with regard to coverage of silver on ABS boards with nickel after electroless coating (results in Table 8). Metal coverage given in [%] indicates the proportion of the board surface that was coated with nickel after 1 min plating time (in some cases, plating time applied departed therefrom). The sequence of the procedure used for performing the test was that of Table 1, the treatment solutions had the compositions indicated in Table 3.

On one side, fluoborate was utilized as an accelerating constituent. Instead of fluoborate, other substances were also used for comparison. The electroless nickel bath contained 2.0 g/l dimethylamine borane.

The concentrations of these substances in the accelerating solution are indicated as well. The results yielded for three different concentrations of silver in the colloidal solution (0.2 g/l, 0.4 g/l and 0.8 g/l) are indicated in Table 8.

EXAMPLE 8

The test was repeated and in this case, coverage was determined depending on whether palladium ions were present in the pickling bath or not. Concentration of silver in the colloidal silver solution amounted to 0.2 g/l and that of dimethylamine borane in the electroless nickel bath to 2 g/l. For the rest, the conditions are the same as in Example 7. The results are indicated in Table 9.

The test results clearly show that the presence of palladium ions in the pickling bath as well as the use of fluoborate ions contribute to a considerable extent to reliably coat plastic surfaces with nickel. Mere presence of fluoborate at neutral pH permitted to entirely coat the ABS boards with nickel even without use of palladium in the pickling bath.

EXAMPLE 9

These results were ascertained by further comparative tests. Tables 10 and 11 show the results of the determination of metal coverage when the silver concentration in the colloidal silver solution was adjusted to 0.4 g/l and to 0.8 g/l, respectively. For the rest, the conditions are the same as in Example 7.

EXAMPLE 10

The previous tests were repeated once more with the exclusive use of $NaBF_4$ for acceleration this time. In this case, no palladium ions were contained in the pickling bath. Concentration of dimethylamine borane in the electroless nickel bath amounted to 1 g/l. For the rest, the conditions are the same as in Example 7. The results are indicated in Table 12.

The results in Table 6, 9, 10 and 11 show that lack of palladium ions in the pickling bath does not prevent metal coverage on the ABS boards from being excellent. Moreover, coverage is all the higher, the higher the silver concentration in the colloidal silver solution.

Although preferred embodiments of the invention are described herein in detail, it will be understood by those skilled in the art that variations may be made thereto within the scope of the appended claims. This includes that any combination of the features according to the present invention disclosed herein is incorporated as to be disclosed in this application as well.

TABLE 1

Process Sequence

| Stage of the process | Temperature [° C.] | Treatment time [min] |
|---|---|---|
| 1. Pickling | 65 (65–70)[1]) | 10 (6–15)[1]) |
| 2. Rinsing | RT[2]) | 2 × 1[3]) |
| 3. Reducing | RT[2]) | 1 |
| 4. Rinsing | RT[2]) | 2 × 1[3]) |
| 5. Pretreating | RT[2]) | 1 |
| 6. Activating | 55 (50–60)[1]) | 5 (2–6)[1]) |
| 7. Rinsing | RT[2]) | 2 × 1[3]) |
| 8. Accelerating | RT[2]) | 0.5 |
| 9. Rinsing | RT[2]) | 2 × 1[3]) |
| 10. Electroless nickel plating | 40 (25–60)[1]) | 10 (6–12)[1]) |

[1]) ranges of application
[2]) RT: room temperature
[3]) twice a minute

TABLE 2

Compositions of Silver Colloid

| No. | AgMS[1]) [g/l] | $Sn(MS)_2$[2]) [g/l] | MSA[3]) [g/l] | Observations |
|---|---|---|---|---|
| a) | 5 | 32 | 16 | dark solution, precipitation is low |
| b) | 5 | 42 | 16 | solution is darker than at a), precipitation is low |
| c) | 10 | 22 | 16 | dark solution, precipitation is low |
| d) | 5 | 32 | 26 | solution is not as dark as at a) through c), deposit |
| e) | 5 | 42 | 26 | very dark solution |
| f) | 10 | 22 | 26 | a dark solution forms immediately, precipitation is high |

[1]) AgMS: silver methane sulfonate
[2]) $Sn(MS)_2$: tin methane sulfonate
[3]) MSA: methane sulfonic acid

TABLE 3

Compositions of the Processing Solutions

| Processing solution | Composition: Substance | Composition: Concentration |
|---|---|---|
| Pickling solution | $CrO_3$ | 380 g/l |
| | $H_2SO_4$, conc. | 380 g/l |
| | $Pd^{2+}$ in the form of $PdSO_4$ | 15 mg/l |
| Reducing solution | $(HO—NH_3)_2SO_4$ | 8 g/l |
| Solution for pretreatment | $Sn(MS)_2$[1]) | 22 g/l |
| | MSA[2]), 70% by weight | 16 g/l |
| Colloidal silver solution | $Ag^+$ in the form of Ag-MS[1]) | 0.2 g/l |
| | $Sn(MS)_2$[1]) | 20 g/l |
| | MSA[2]), 70% by weight | 16 g/l |
| Accelerating solution | $NaBF_4$ | 80 g/l |
| | HCl, 37% by weight | 40 ml/l |
| | pH | <1 |
| Electroless Ni | $NiSO_4.6H_2O$ | 1.15 g/l |
| | $H_3BO_3$ | 0.8 g/l |
| | citric acid | 2.5 g/l |
| | $NH_3$, 25% by weight | 40 g/l |
| | $NaH_2PO_2.H_2O$ | 1.9 g/l |
| | DMAB[3]) | 2 g/l |
| | pH | 9 |

[1]) MS: methane sulfonate
[2]) MSA: methane sulfonic acid
[3]) DMAB: dimethyl amine borane

TABLE 4

Adsorption of Ag on ABS Boards:

| No. | AgMS[1]) [g/l] | $Sn(MS)_2$[2]) [g/l] | MSA[3]) | $Ag_{ads}$ [mg/m$^2$] |
|---|---|---|---|---|
| a) | 5.0 | 22 | 16 | 244 |
| b) | 2.5 | 22 | 16 | 207 |
| c) | 1.0 | 22 | 16 | 68 |

[1]) AgMS: silver methane sulfonate
[2]) $Sn(MS)_2$: tin methane sulfonate
[3]) MSA: methane sulfonic acid

TABLE 5

Adsorption of Cu, Ag, Sn on ABS Boards:

| No. | $Cu(MS)_2$[1]) [g/l] | AgMS[2]) [g/l] | $Cu_{ads}$ [mg/m$^2$] | $Ag_{ads}$ [mg/m$^2$] | $Sn_{ads}$ [mg/m$^2$] |
|---|---|---|---|---|---|
| a) | 2 | 10 | 2.9 | 305.6 | 308.3 |
| b) | 4 | 10 | 6.2 | 255.6 | 400.0 |
| c) | 10 | 10 | 13.6 | 14.6 | 277.8 |
| d) | 0 | 2.5 | 0 | 14.8 | 155.6 |
| e) | 0.5 | 2.5 | 8.3 | 17.8 | 161.1 |
| f) | 1 | 2.5 | 5.6 | 6.7 | 144.4 |
| g) | 2.5 | 2.5 | 6.9 | 3.2 | 130.6 |

[1])$Cu(MS)_2$: copper methane sulfonate
[2])$Ag(MS)_2$: silver methane sulfonate

TABLE 6

Metal Coverage and Initiation Period with Various Accelerating Compositions

| Accelerator Components | | | Metal adsorbed on plastic surface | | |
|---|---|---|---|---|---|
| MSA[1]) [g/l] | $Cu(MSA)_2$[2]) [g/l] | KF [g/l] | silver [mg/m$^2$] | tin [mg/m$^2$] | Initiation period [sec] |
| 0 | 0 | 0 | 11.05 | 6.68 | ∞ |
| 40 | 60 | 25 | 6.68 | 1.54 | >60 |
| 80 | 60 | 25 | 6.72 | 0.30 | 26 |
| 160 | 60 | 25 | 8.58 | 0.34 | 22 |
| 80 | 30 | 25 | 7.40 | 0.34 | 44 |
| 80 | 120 | 25 | 8.90 | 0.19 | 21 |
| 80 | 60 | 12 | 10.36 | 0.32 | 23 |
| 80 | 60 | 50 | 10.80 | 0.13 | 42 |
| 80 | 125 | 25 | | | 21 |
| without accelerator | | | 11.16 | 6.10 | |
| | | | 10.44 | 6.96 | |

[1]) MSA: methane sulfonic acid
[2]) $Cu(MS)_2$: copper methane sulfonate

TABLE 7

Accelerator Compositions

| Test No. | Accelerator Composition |
|---|---|
| 1 | no additions (pure water) |
| 2 | 80 g/l of a 70% by weight methane sulfonic acid solution<br>60 g/l copper methane sulfonate<br>25 g/l potassium fluoride |
| 3 | 50 g/l oxalic acid |
| 4 | 50 g/l citric acid |
| 5 | 50 g/l oxalic acid<br>10 g/l potassium fluoride |
| 6 | 50 g/l citric acid<br>10 g/l potassium fluoride |

TABLE 8

Metal Coverage after Treatment with Various Accelerating Systems

| Accelerating Compound | Metal Coverage [%] | | | |
|---|---|---|---|---|
| | $c_{Ag}$ = 0.2 g/l | $c_{Ag}$ = 0.4 g/l | $c_{Ag}$ = 0.8 g/l | pH |
| Citric acid (50 g/l) | 0 | 20 | 90 | 1.6 |
| Ascorbic acid (50 g/l) | 0 | 0 | 70 | 2.0 |
| Tartaric acid (50 g/l) | 0 | 10 | 90 | 1.5 |
| Fluoboric acid 50% v/v (20 ml/l) | 100 | 100 | 100 | 0.7 |
| KNa-Tartrate (50 g/l) | 0 | 5 | 30 | 7.1 |
| Hydroxylammonium sulfate (50 g/l) | 0 | 0 | 90*) | 3.3 |

The plastic plates were treated in the electroless nickel plating bath for 2 min in each case (except for *): 10 min treatment time)

TABLE 9

Metal Coverage After Treatment With Various Accelerating Systems

| Accelerator compound | Metal coverage [%] | |
|---|---|---|
| | Pickling solution with $Pd^{2+}$ | Pickling solution without $Pd^{2+}$ |
| Citric acid (50 g/l) | 85 | 0 |
| Ascorbic acid (50 g/l) | 40 | 0 |
| Tartaric acid (50 g/l) | 10 | 0 |
| $HBF_4$ (20 ml/l) | 80 | 0 |

TABLE 9-continued

Metal Coverage After Treatment With Various Accelerating Systems

| Accelerator compound | Metal coverage [%] | |
|---|---|---|
| | Pickling solution with $Pd^{2+}$ | Pickling solution without $Pd^{2+}$ |
| $NaBF_4$ (80 g/l) | 100 (after 2 min[1])) | 100 (after 3 min[1])) |
| KNa-tartrate (50 g/l) | 0 | 0 |
| $(HO—NH_3)_2SO_4$ (50 g/l) | 0 | 0 |

[1]) Determination of the coverage after coating in the electroless nickel plating bath for x min

TABLE 10

Metal Coverage After Treatment with Various Accelerating Systems ($c_{Ag}$ = 0.4 g/l)

| Accelerator compound | Metal coverage [%] | |
|---|---|---|
| | Pickling solution with $Pd^{2+}$ | Pickling solution without $Pd^{2+}$ |
| Citric acid (50 g/l) | 45 | 0 |
| Ascorbic acid (50 g/l) | 0 | 0 |
| Tartaric acid (50 g/l) | 0 | 0 |
| $HBF_4$ (20 ml/l) | 100 (after 3 min[1])) | 20 |
| $NaBF_4$ (80 g/l) | 100 (after 1 min[1])) | 100 (after 1 min[1])) |
| KNa-tartrate (50 g/l) | 0 | 0 |
| $(HO—NH_3)_2SO_4$ (50 g/l) | 0 | 0 |

[1]) Determination of the coverage after coating in the electroless nickel plating bath for x min

TABLE 11

Metal Coverage After Treatment with Various Accelerating Systems ($c_{Ag}$ = 0.8 g/l)

| Accelerator compound | Metal coverage [%] | |
|---|---|---|
| | Pickling solution with $Pd^{2+}$ | Pickling solution without $Pd^{2+}$ |
| Citric acid (50 g/l) | 0 | 0 |
| Ascorbic acid (50 g/l) | 0 | 0 |
| Tartaric acid (50 g/l) | 55 | 0 |
| $HBF_4$ (20 ml/l) | 100 (after 2 min[1])) | 100 (after 3 min[1])) |
| $NaBF_4$ (80 g/l) | 100 (after 1 min[1])) | 100 (after 1 min[1])) |
| KNa-tartrate (50 g/l) | 5 (after 10 min[1])) | 0 |
| $(HO—NH_3)_2SO_4$ (50 g/l) | 0 | 0 |

[1]) Determination of the coverage after coating in the electroless nickel plating bath for x min

TABLE 12

Metal Coverage After Treatment with $NaBF_4$

| Concentration of | Metal coverage [%] | | |
|---|---|---|---|
| $NaBF_4$ [g/l] | $c_{Ag}$ = 0.2 g/l | $c_{Ag}$ = 0.4 g/l | $c_{Ag}$ = 0.8 g/l |
| 20 | 0 | 0 | 40 |
| 40 | 0 | 0 | 100 |
| 60 | 20 | 100 (after 3.5 min[1])) | 100 |
| 80 | 40 | 100 (after 2 min[1])) | 100 |

[1]) Determination of the coverage after coating in the electroless nickel plating bath for x min

What is claimed is:

1. A method for electroless plating of surfaces comprising the following method steps:

a. pickling the surfaces with a solution containing chromate ions;

b. activating the pickled surfaces with a silver colloid containing stannous ions;

c. treating the activated surfaces with an accelerating solution in order to remove tin compounds from the surfaces wherein the accelerating solution additionally contains methane sulfonate anions;

d. depositing, by means of an electroless nickel plating bath, a layer that substantially consists of nickel to the surfaces treated with the accelerating solution, the electroless nickel plating bath containing at least one reducing agent selected from the group comprising consisting of borane compounds.

2. The method according to claim 1, wherein the accelerating solution contains fluoride ions.

3. The method according to any one of claims 1 and 2, wherein the pH of the accelerating solution is at most about 7.

4. The method according to any one of claims 1 and 2, wherein the pH of the accelerating solution is at most about 2.

5. The method according to any one of claims 1 and 2, wherein the accelerating solution additionally contains metal ions selected from the group consisting of copper ions, iron ions and cobalt ions.

6. The method according to any one of claims 1 and 2, wherein the accelerating solution does not contain chloride ions.

7. The method according to any one of claims 1 and 2, wherein the silver colloid additionally contains methane sulfonate anions.

8. The method according to any one of claims 1 and 2, wherein the silver colloid additionally contains at least one further reducing agent.

9. The method according to claim 8, wherein the additionally contained at least one further reducing agent is selected from the group consisting of hydroxyphenyl compounds, hydrazine and derivatives thereof.

* * * * *

UNITED STATES PATENT AND TRADEMARK OFFICE

CERTIFICATE OF CORRECTION

PATENT NO. : 6,902,765 B2
DATED : June 7, 2005
INVENTOR(S) : Brandes et al.

It is certified that error appears in the above-identified patent and that said Letters Patent is hereby corrected as shown below:

Title page,
Item [75], Inventors, replace "Herman" with -- Hermann --;

Column 17,
Line 16, delete "comprising".

Signed and Sealed this

Twenty-second Day of November, 2005

JON W. DUDAS
*Director of the United States Patent and Trademark Office*